US006027188A

United States Patent [19]

Nickens

[11] Patent Number: 6,027,188

[45] **Date of Patent: *Feb. 22, 2000**

[54] CASE-TO-COUNTER CONVERSION KIT

[75] Inventor: Lowell W. Nickens, Portland, Oreg.

[73] Assignee: Classic Exhibits, Inc., Milwaukie, Oreg.

[ * ] Notice: This patent issued on a continued prosecution application filed under 37 CFR 1.53(d), and is subject to the twenty year patent term provisions of 35 U.S.C. 154(a)(2).

[21] Appl. No.: 08/874,643

[22] Filed: Jun. 13, 1997

Related U.S. Application Data

[60] Provisional application No. 60/026,402, Sep. 20, 1996.

[51] Int. Cl.[7] ..... A47B 87/00

[52] U.S. Cl. ..... 312/111; 312/108; 312/140.2; 312/107

[58] Field of Search ..... 312/4, 3, 108, 312/107, 111, 140.1, 140.2; 108/157.16, 158.12

[56] References Cited

U.S. PATENT DOCUMENTS

| | | | |
|---|---|---|---|
| 677,114 | 6/1901 | Buckingham . | |
| 1,949,326 | 2/1934 | Peterson | 312/107 X |
| 2,431,711 | 12/1947 | Scott | 312/107 X |
| 2,455,991 | 12/1948 | Goldfield et al. . | |
| 3,125,387 | 3/1964 | Abrahamson | 312/108 X |
| 3,365,848 | 1/1968 | Piget | 312/257.1 X |
| 3,586,409 | 6/1971 | Cisler | 312/111 |
| 4,163,592 | 8/1979 | Nelson | 312/111 X |
| 4,243,279 | 1/1981 | Ackeret | 312/107 |
| 4,371,221 | 2/1983 | Citterio | 312/111 X |
| 4,400,043 | 8/1983 | Rossow | 312/111 |
| 4,660,905 | 4/1987 | Conner et al. | 312/108 X |
| 4,819,567 | 4/1989 | Thompson et al. . | |
| 5,039,177 | 8/1991 | Newell et al. | 312/263 X |
| 5,402,738 | 4/1995 | Carr et al. . | |
| 5,466,057 | 11/1995 | Blankenburg | 312/111 X |
| 5,486,043 | 1/1996 | Carr et al. . | |
| 5,718,494 | 2/1998 | Luddemann . | |
| 5,941,616 | 8/1999 | Billingham | 312/111 |

FOREIGN PATENT DOCUMENTS

| | | | |
|---|---|---|---|
| 346904 | 3/1937 | Italy | 312/107 |
| 346947 | 3/1937 | Italy | 312/107 |
| 194952 | 3/1923 | United Kingdom | 312/107 |
| 477979 | 4/1936 | United Kingdom | 312/107 |

OTHER PUBLICATIONS

Abex Display Systems International, Exposure Catalog (20 pages).

Nomadic Display, Convert–A–Case advertisement (1 page).

"A Strong Case for Choosing Nomadic Display"; Nomadic Display (2 pages).

"A Structure for Success" Featherlight Formula (6 pages).

"Your Competitive Edge"; Skyline Displays and Graphics (26 pages).

"Nimlock Display and Exhibit Systems"; Nimlock (16 pages).

*Primary Examiner*—Peter M. Cuomo
*Assistant Examiner*—Hanh V. Tran
*Attorney, Agent, or Firm*—Marger Johnson & McCollom, P.C.

[57] ABSTRACT

A case to counter conversion kit includes two case bodies which are positioned to form a storage space between them. Two shelves are attached between the case bodies to provide storage surfaces and to lock the bodies together, thereby forming a stable base for a counter. The shelves include tongues along opposite edges of the shelves. The tongues slide into tracks or moldings attached in channels which are located on opposing faces of the case bodies, thereby locking the shelves and bodies together. A multi-section counter top is attached to the tops of the case bodies and locked in place by pins located in channels on the tops of the case bodies which engage slots in mating faces of the counter top sections. A roll-up counter top cover fits into a recess in the top of the counter assembly. A flexible panel is wrapped around the case bodies and secured in place with hook and loop fasteners. A hinged door is attached to the flexible panel and provides access to the storage space between the case bodies. The shelves, counter top sections, and counter top cover are designed to fit in the case bodies when not in use.

24 Claims, 3 Drawing Sheets

CASE-TO-COUNTER CONVERSION KIT

This application claims priority from U.S. Provisional Patent Application No. 60/026,402 filed Sep. 20, 1996.

BACKGROUND OF THE INVENTION

1. Field of the Invention

This invention relates generally to carrying cases for trade show exhibits and more particularly to a method and apparatus for converting one or more carrying cases into a counter.

2. Description of the Related Art

Trade show displays are frequently transported in carrying cases which must be sent to a storage area after the contents are emptied. This increases the time and expense associated with operating a trade show display, since the exhibitor must have the carrying cases sent to storage before the show, then wait to have it returned from storage at the conclusion of the show.

To eliminate the storage and transport problems, attempts have been made to incorporate carrying cases into the trade show display exhibit. One technique is to take two cases and strap or tie them together to form a solid base. Then, a fabric panel is wrapped around the cases to conceal them. Finally, a countertop is mounted on top of the cases to form a usable counter.

A problem with this technique, however, is that it leaves no space for storage under the counter for brochures, pamphlets, etc. The cases take up most of the room under the counter, thus eliminating any possible space for storage.

Accordingly, a need remains for a technique for converting carrying cases to a counter which overcomes the above-mentioned problems.

SUMMARY OF THE INVENTION

It is, therefore, an object of the invention to provide a technique for converting carrying cases to a counter while still allowing room for storage underneath the counter.

Another object of the invention is to provide a technique for tieing cases and countertops together to create a stable counter.

A further object of the invention is to provide a technique to access storage under a converted counter.

To accomplish these objectives, the applicant has invented a method and apparatus for converting carrying cases to a counter. Two case bodies are spaced apart to form an accessable storage space between the bodies. A countertop assembly is attached to the tops of the cases to provide a work surface and to hold the case bodies in place. One or more shelves can be attached between two case bodies so as to provide storage surfaces and to add more stability to the counter assembly. The shelves include tongues along opposite edges of the shelves. The tongues slide into tracks or moldings attached in channels which are located on opposing faces of the case bodies, thereby locking the shelves and bodies together.

The countertop assembly is fabricated in multiple sections. The counter top is locked in place by pins located in channels on the tops of the case bodies which engage slots in mating faces of the counter top sections.

In a preferred embodiment, the counter includes a fabric panel having a hinged door which wraps around the counter and provides access to the storage space. The panel is secured in place with hook and loop fasteners. A preferred embodiment also includes a recessed portion in the countertop for receiving a counter top cover. The shelves, countertop assembly, and fabric panel are designed to fit in the case when not in use.

The foregoing and other objects, features and advantages of the invention will become more readily apparent from the following detailed description of a preferred embodiment of the invention which proceeds with reference to the accompanying drawings.

DETAILED DESCRIPTION

Figure 1:
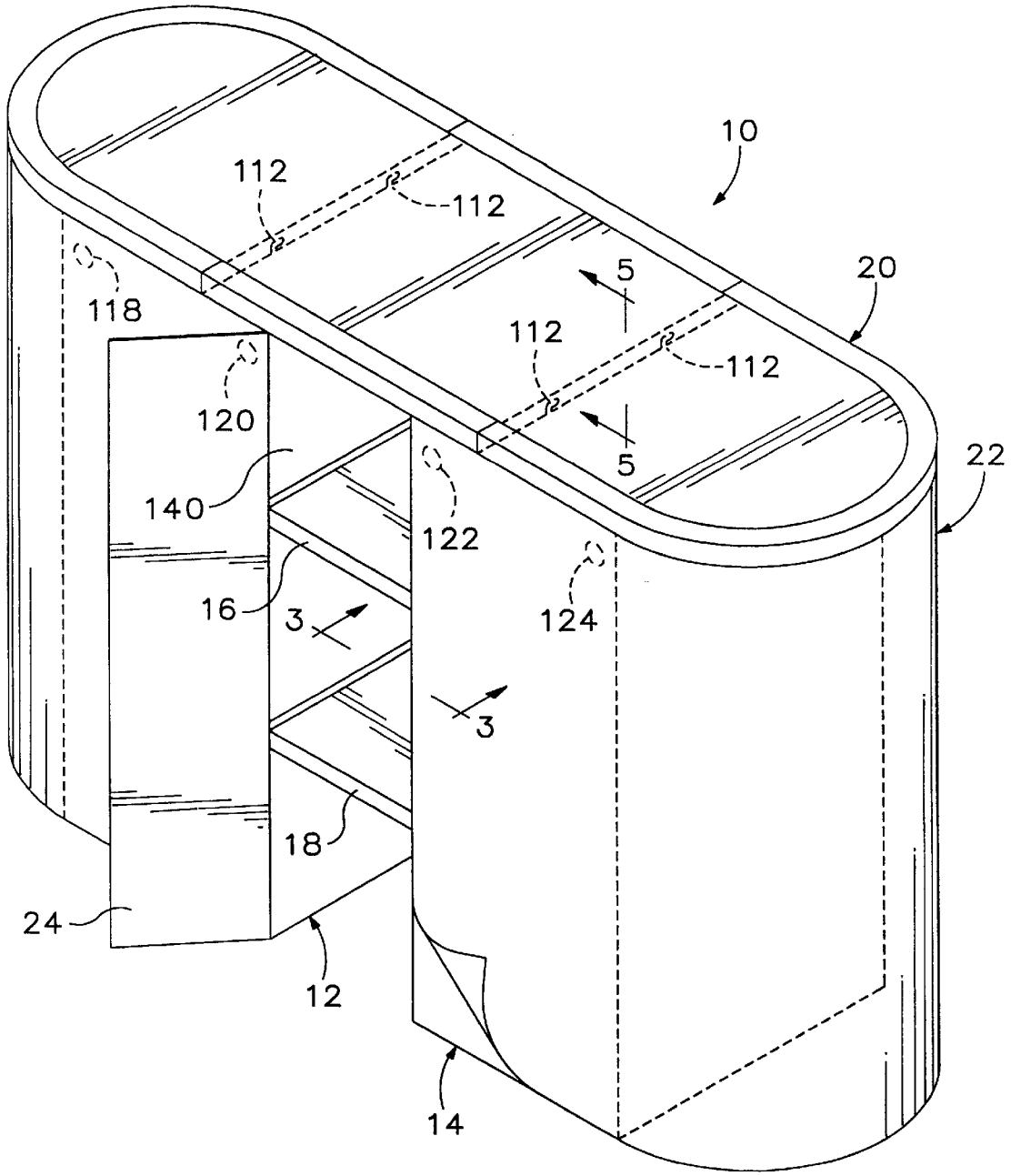
FIG. 1 is a perspective view of an embodiment of a case-to-counter conversion kit in accordance with the present invention.

Indicated generally at 10 in FIG. 1, is an embodiment of a case-to-counter conversion kit in accordance with the present invention. Prior to describing the detailed structure of the conversion kit 10, the key components of the kit will be identified followed by a brief description of the assembly of the system. Then a more detailed description of each of the components will be provided along with a more detailed description of the method of assembly.

Referring to FIG. 1, the conversion kit includes first and second case bodies 12 and 14 which are spaced apart to form an accessible storage space 140. A countertop assembly 20 is attached to the tops of the two case bodies to hold the case bodies in place and to form a working surface for the user. First and second shelves 16 and 18 are attached between the case bodies to provide storage surfaces. The shelves also lock the case bodies together to form a dimensionally stable counter base. A flexible panel 22 is wrapped around the counter to conceal the case bodies. A hinged door 24 provides access to the storage space between the case bodies.

Figure 2:
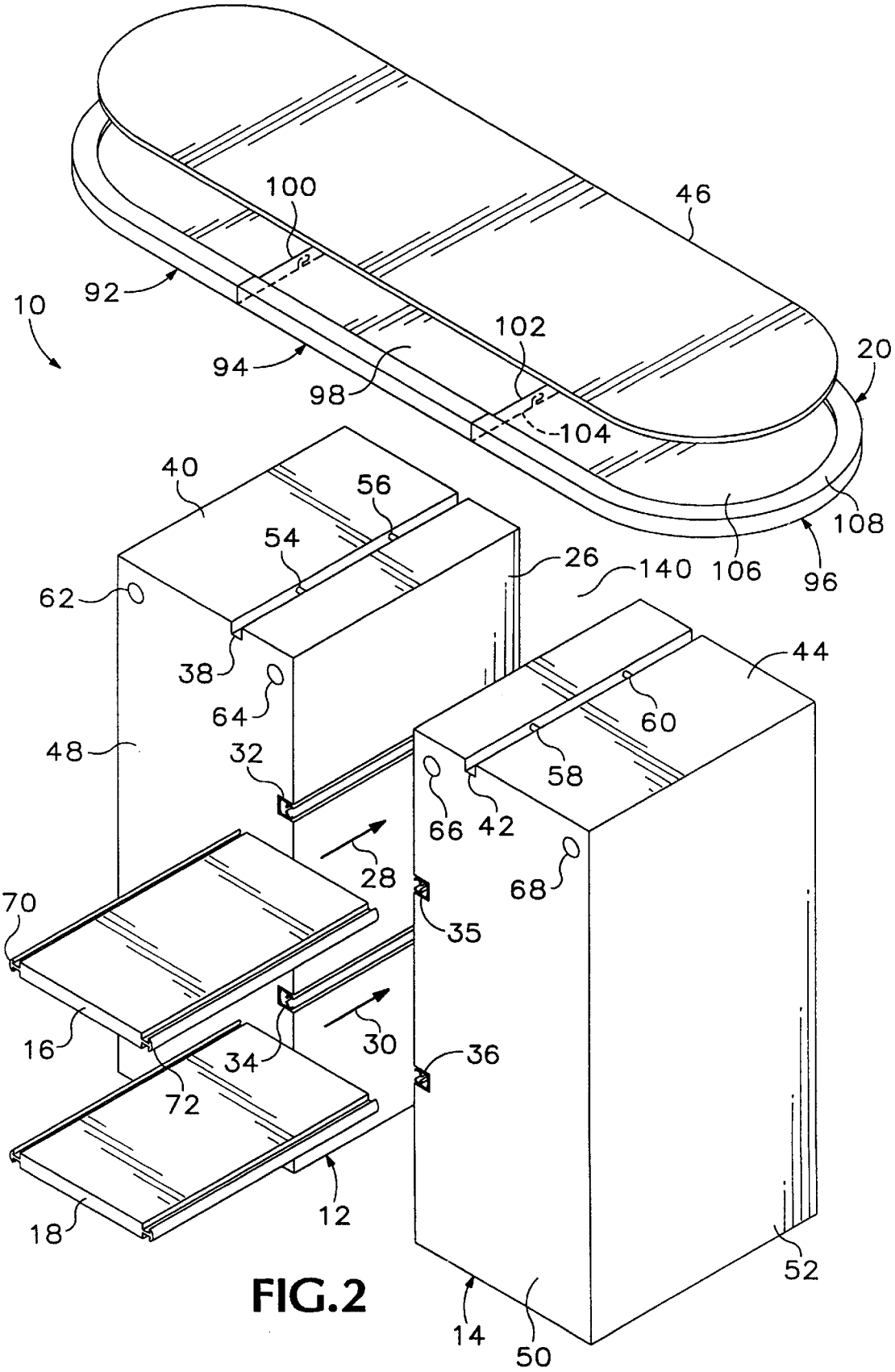
FIG. 2 is an exploded perspective view showing more details of the various components of the case-to-counter conversion kit of FIG. 1.

Referring to FIG. 2, to convert the carrying cases into a counter, the case bodies 12 and 14 are first positioned so that the front face 26 of the first case body 12 is positioned opposite the front face (not shown) of the second case body 14. Shelves 16 and 18 are then slid between the case bodies as shown by arrows 28 and 30. The sides of shelves 16 and 18 engage lateral channels 32 and 34 in the front face of case body 12 and lateral channels 35 and 36 in the front face of case body 14, thereby locking the case bodies together and forming storage surfaces in the storage space 140 between the case bodies. The flexible panel 22 is wrapped around the entire counter assembly except for the storage space formed by shelves 16 and 18. Next, the hinged door 24 is attached to the first case body or the flexible panel so as to enclose, but provide access to, the storage area between the case bodies. The countertop 20 is then attached to the tops of the case bodies and locked into horizontal channel 38 on the top surface 40 of the first case body 12 and horizontal channel 42 on the top surface 44 of the second case body. Finally, a counter top cover 46 is attached to the top of the countertop assembly 20.

More detailed consideration will now be given to the structure of the present invention.

Case body 12 is shaped generally like a rectangular box and has a vertical front surface 26, a vertical left side surface 48, a vertical back surface (not shown) and a vertical right side surface (not shown). The first case body also has a horizontal top surface 40 and a horizontal bottom surface (not shown). The second case body 14 has substantially the same structure as the first case body and includes a vertical front surface not shown, a vertical left surface 50, a vertical right surface not shown, and a vertical back surface 52. The second case body also includes a horizontal top surface 44 and a horizontal bottom surface not shown. The case bodies are preferably made from rotational molded plastic.

The front surface 26 of case body 12 includes two parallel channels 32 and 34 which run horizontally across the front surface between the left and right side surfaces for attaching the shelves 16 and 18 to the case body. A channel 38 runs horizontally across the top surface 40 of the case body between the left and right sides. Two pins 54 and 56 span the width of the channel 38 in a direction perpendicular to the axis of the channel for locking the countertop assembly 20 to the top of the case body. The left side surface 48 of the case body includes two recesses 62 and 64 located near the top of the case for receiving two pieces of hook and loop fasteners such as that sold under the trademark "VELCRO". The right side surface of the case body, which is not visible in the view of FIG. 2, also includes two recesses for receiving hook and loop fasteners located near the top of the case body. The hook and loop fasteners act as attachment points for securing the flexible panel 22 to the counter assembly as shown in FIG. 1.

Referring again to FIG. 2, the second case body 14 is substantially identical to the first case body and includes channels 35, 36, and 42, pins 58 and 60, recesses 66 and 68, and hook and loop fasteners as discussed in reference to the first case body.

The shelf 16 includes tongues 70 and 72 projecting from opposing edges of the shelf. Each tongue has a T-shaped cross-section and extends along the entire length of the shelf. Shelf 18 is identical in structure to shelf 16.

Figure 3:
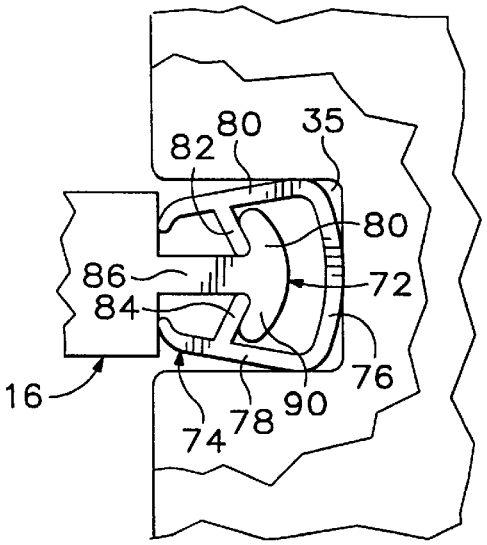
FIG. 3 is an enlarged view of the shelf attachment taken along line 3—3 in FIG. 1.

More detail of the shelf-to-case body attachments will now be described with reference to FIG. 3.

Channel 35 includes a track 74, fabricated of an extruded polymeric material such as PVC or the like, and running the entire length of the channel. The track has a generally U-shaped cross-section including a bottom portion 76 and two sidewalls 78 and 80. The track 74 also includes two ridges 82 and 84 which extend inwardly from the sidewalls 80 and 78, respectively, and run the entire length of the track.

The tongue 72 which extends from the side edge of shelf 16 includes a horizontal portion 86 extending laterally from the edge of the shelf and two ridges 88 and 90 extending in opposite directions perpendicular to the horizontal portion 86 at the outer edge of the horizontal portion, thereby forming a T-shaped rail.

The track 74 is firmly attached inside the channel 35 so that, when the shelf 16 is slid into the channel, the ridges 82 and 84 of the track engage ridges 88 and 90 of the tongue, thereby securely locking the shelf and case body together. The attachment between shelf 16 and channel 35 is typical of the attachment between shelf 16 and channel 32 and shelf 18 and channels 34 and 36.

Referring again to FIG. 2, the countertop assembly 20 is comprised of a first rounded end section 92, a rectangular-shaped center section 94 and a second semicircular end section 96. The center section 94 includes a flat top surface 98 and two flat vertical mating surfaces 100 and 102 located at opposite edges of the center section and depending downwardly from the flat portion 98. The semicircular end section 96, which is identical to end section 92, includes a single vertical flat mating surface 104 which depends downwardly from a flat portion 106. When the countertop assembly 20 is assembled, the mating surface 104 of end section 96 is coupled to the flat mating surface 102 of center section 94, and mating surface 100 of center section 94 is coupled to the mating surface of end section 92 such that the three sections form a single oval-shaped countertop 20. Each section 92, 94 and 96 includes a lip protruding upwardly along the periphery of the section such that, when the countertop is assembled, they form a continuous lip 108 around the entire outer periphery of the countertop assembly. The counter top sections are preferably fabricated from vacuum formed polymeric material.

A roll-up counter top cover 46 is attached using hook and loop fasteners (not shown) to the top surface of the countertop assembly 20 and is positioned within a recess formed by lip 108 such that the top of the counter top cover 46 is flush with the top surface of the lip. By fabricating the counter top cover from a thin material such as 0.001 inch thick ABS polymer, it can be made flexible enough to roll-up for easy storage.

Figure 5:
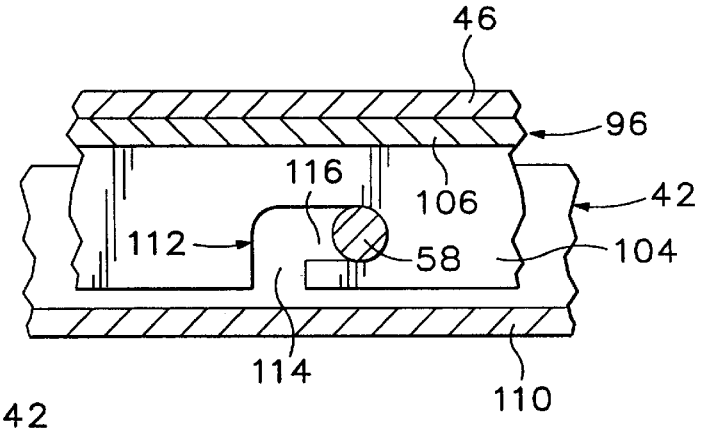
FIG. 5 is an enlarged sectional view of the countertop locking mechanism taken along line 5—5 in FIG. 1.

More detail of the countertop-to-case body attachment will be described with reference to FIG. 5 which is a sectional view of the structure inside channel 42 taken along line 5—5 in FIG. 1. The channel 42 includes a bottom wall 110 and a pin 58 which spans the sidewalls of the channel 42 and is preferably made from a rivet. End section 96 of countertop assembly 20 includes a flat section 106 and a flat vertical mating surface 104 depending downwardly from the flat surface 106. Mating surface 104 includes an inverted L-shaped slot 112 having a vertical portion 114 which opens along the lower edge of mating surface 104 and a horizontal portion 116 which communicates with the vertical portion of the slot 114. Pin 58 engages the vertical portion 114 of slot 112 when the end section 96 is positioned over the case body 14 and lowered onto the top. The pin 58 then engages the horizontal portion 116 when the end portion of the countertop is moved sideways to lock it in place. The counter top cover 46 is shown in place over the end portion 96 of the countertop. Each flat mating surface of each section of the countertop assembly includes two inverted L-shaped slots 112 as shown in FIG. 1.

Referring again to FIG. 1, flexible panel 22 is preferably made from a pliable material such as polymer-coated fabric which is generally low in cost and easy to roll. A piece of fabric is preferably glued to the outer surface of the panel to provide a finished appearance. The panel 22 includes four hook and loop fasteners 118, 120, 122 and 124 shown in phantom form in FIG. 1, and four additional hook and loop fasteners (not shown) for engaging the hook and loop fasteners on the case bodies shown in FIG. 2.

The door 24 can be made of any suitable material such as polystyrene or vinyl, but is preferably made from two sheets of heavy weigh vinyl taped or glued together. The door is preferably attached to the flexible panel with sail tape which acts as a hinge.

In a preferred embodiment, a first piece of magnetic tape having a first polarity is mounted to flexible panel 22 or to the case body 14 along the edge of the of the storage space. A second piece of magnetic tape having the opposite polarity is mounted to the inside surface of the door 24. When the door is closed, the pieces of magnetic tape hold the door in the closed position. The first piece of tape is preferably attached to a strip of polystyrene which is attached to the back of the flexible panel 22 and extends beyong the edje of the panel.

Figure 4:
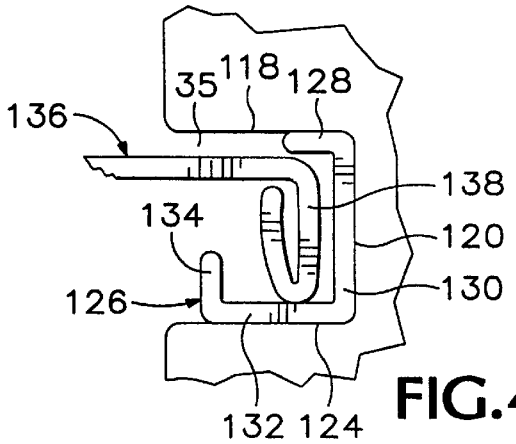
FIG. 4 is an enlarged sectional view of a preferred embodiment of a shelf attachment taken along line 3—3 in FIG. 1.

A preferred embodiment of the shelf-to-case body attachment will now be described with reference to FIG. 4. A channel 35 includes a top wall 118, a sidewall 120 and a bottom wall 124. A track-like molding 126 has a generally C-shaped cross-section including a top wall 128, a sidewall 130, a bottom wall 132 and a ridge 134 which protrudes upwardly from the bottom wall. The molding 126 is disposed within the channel and extends the entire length of the channel. The molding is preferably fabricated from an extruded polymeric material.

A shelf 136 has a ridge 138 which runs the length of the shelf along one of the outer edges such that, when the shelf is slid into the channel, the ridge 138 of the shelf engages the molding 126, thereby locking the shelf to the case body. This alternative attachment can be used with any of channels 32, 34, 35 and 36 in FIG. 2. Preferably, the shelf 136 is fabricated from 22 gage galvanized, powder coated sheet metal. The ridge 138 is formed by bending down the end of shelf 136. The sheet metal is preferably rolled over double back to form a smooth edge.

More detailed consideration will now be given to the method of converting a carrying case to a counter in accordance with the present invention with reference to FIGS. 1 and 2.

Case bodies 12 and 14 are first positioned opposite each other with the front surface of each body facing the front surface of the other. The case bodies are then spaced apart the proper distance so that the edges of shelves 16 and 18 will engage channels 32, 34, 35 and 36 when they are slid into position. Shelves 16 and 18 are then positioned so that the tongues or channels at the opposite edges of the shelves will engage the track or molding in the respective channels. The shelves 16 and 18 are then slid into place between the case bodies, thereby locking the bodies together to form a rigid base and providing two surfaces for storage.

Next, the flexible panel 122 is wrapped around the counter assembly and aligned so that the hook and loop fasteners on the panel engage the hook and loop fasteners mounted to the case body. If door 24 is not attached to the flexible panel 22, it is positioned over the storage area 140 and mounted to case body 12 or flexible panel 22 with any suitable hinge.

Next, center section 94 of the countertop assembly 20 is positioned between the two case bodies and lowered into place such that pins 54, 56, 58 and 60 engage the inverted L-shaped slots 112 in the mating surfaces of the countertop section. Section 94 is then slid sideways to lock it in place. In a similar manner, end sections 92 and 96 are lowered into position on top of case bodies 12 and 14, and slid sideways to lock them in place. Finally, counter top cover 46 is lowered into place in the recess on top of countertop assembly 120 and pressed down to engage the hook and loop fasteners which hold it in place.

Thus, the present invention provides a useful storage area under a counter while obviating the need for storage of the case bodies. Preferably, the various rigid components of a case-to-counter conversion kit in accordance with the present invention are sized so as to fit inside the case bodies when not in use, and the flexible components such as the flexible panel 22 and counter top cover 46 are made out of material which allows them to be rolled up and stored within the case body.

Figure 6:
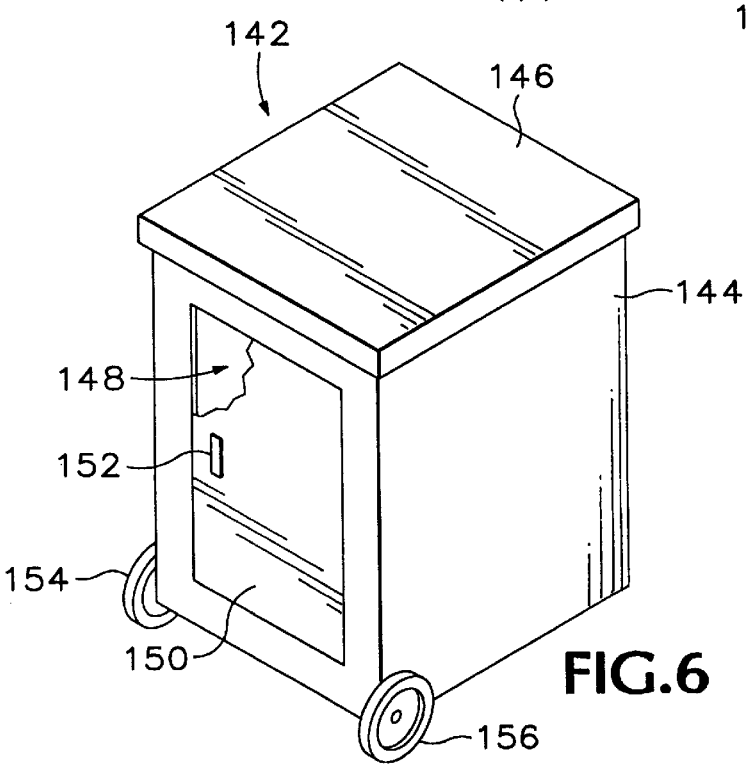
FIG. 6 is a perspective view of a second embodiment of a case-to-counter conversion kit in accordance with the present invention.

A second embodiment of a case-to-counter conversion system in accordance with the present invention is shown generally at 142 in an assembled configuration in FIG. 6. The system includes a case body 144, and a removable countertop 146 that is sized to fit inside the case body when not in use. A storage space 148 is provided inside of the case body 144. A hinged door 150 having a handle 152 covers, and provides access to, the storage space.

Many of the features described above with respect to the embodiment of FIG. 1 can be applied to the embodiment of FIG. 6. For example, a flexible panel (not shown) can be wrapped around the case body, and the countertop can be attached to the case body with a channel and mating surface as described above.

The embodiment of FIG. 6 also includes a pair of wheels 154, 156 which are attached to the bottom of the case body to facilitate moving the counter.

When used as a carrying case, the countertop 146 of the case-to-counter conversion system of FIG. 6 is stored inside the case body 144 which is also used to carry other things in the storage space 148.

To convert the case to a counter, the case body is placed in a suitable location, and then the countertop is removed from the case body and attached to the top of the case body. The countertop then forms a usable work surface with a storage space 148 underneath.

Having described and illustrated the principles of the invention in a preferred embodiment thereof, it should be apparent that the invention can be modified in arrangement and detail without departing from such principles.

I claim:

1. A method for converting a carrying case to a presentable counter suitable for use at a tradeshow comprising:

providing a carrying case body and a countertop;

attaching the countertop to the case body, so as to conceal a top surface of the case body;

providing a storage space under the countertop;

wrapping a panel around the counter except for the storage space, thereby leaving the storage space accessible;

and providing a door to cover and provide access to the storage space.

2. A method according to claim 1 further including:

providing a second case body;

spacing the case body apart from the second case body to form the storage space therebetween; and attaching the countertop to the second case body to fix the location of the storage space between the case bodies.

3. A method according to claim 2 further including attaching a shelf between the case bodies.

4. A method according to claim 3 further including locking the shelf and case bodies together.

5. A system for carrying tradeshow materials and providing a counter having a presentable work surface suitable for use at a tradeshow comprising:

a carrying case body;

a countertop that can be attached to the case body, so as to conceal a top surface of the case body;

a storage space under the countertop;

flexible panel that can be wrapped around the counter to conceal the case body so as to leave the storage space accessible;

and a door that can be attached to the flexible panel for covering and providing access to the storage space.

6. A system according to claim 5 further including:

a second carrying case body; and wherein the countertop can be attached to the case bodies to hold the case bodies with a storage space therebetween and to conceal the top surface of the second case body.

7. A system according to claim 6 further including a shelf that can be attached between the case bodies.

8. A system according to claim 7 wherein the shelf locks the case bodies together when attached between the case bodies.

9. A system according to claim 7 wherein the first case body includes a channel for engaging a first side of the shelf.

10. A system according to claim 9 wherein:

the shelf includes a second side opposite the first side; and the second case body includes a channel for engaging the second side of the shelf.

11. A system according to claim 7 wherein the shelf is sized to fit inside one of the case bodies.

12. A system according to claim 5 wherein the countertop is sized to fit inside the case body.

13. A system according to claim 5 further including a countertop cover that can be attached to the countertop.

14. A system according to claim 5 wherein the case body includes a channel for engaging the countertop.

15. A system according to claim 5 wherein the countertop includes:

a first end section;

a center section; and a second end section, wherein all three sections are detached from each other and adapted to be readily attached to the case body to form a complete countertop.

16. A counter for providing a presentable work surface at a tradeshow comprising:

a carrying case body for carrying tradeshow materials;

a countertop removably attached to the case body, so as to conceal a top surface of the case body;

a storage space under the countertop;

a removable panel wrapped around the case body to conceal the case body but leave the storage space accessible;

and a door removably attached to the panel for covering and providing access to the storage space.

17. A counter according to claim 16 further including a second case body removably attached to the countertop and spaced apart from the case body to form the storage space therebetween.

18. A counter according to claim 17 further including a shelf attached between the case bodies.

19. A system according to claim 18 wherein the shelf is sized to fit inside the case body.

20. A counter according to claim 16 wherein the countertop is sized to fit inside case body.

21. A method for converting a carrying case to a presentable counter suitable for use at a tradeshow comprising:

providing a carrying case body and a countertop;

attaching the countertop to the case body;

providing a storage space under the countertop;

concealing the case body by wrapping a panel around the counter except for the storage space, thereby leaving the storage space accessible;

and providing a door to cover and provide access to the storage space.

22. A system for carrying tradeshow materials and providing a work surface comprising:

a carrying case body;

a countertop that can be attached to the case body;

a panel that can be attached to the case body; and a storage space under the countertop;

wherein the countertop and panel are adapted to conceal a top surface of the case body;

wherein the panel is adapted to conceal the case body so as to leave the storage space accessible;

and a door that can be attached to the panel for covering and providing access to the storage space.

23. A system for transporting trade show materials and providing a presentable counter comprising:

a first carrying case body;

a second carrying case body;

a countertop that can be attached to the case bodies to position the case bodies with an accessible storage space therebetween and to conceal the tops of the case bodies;

a flexible panel that can be wrapped around the case bodies to conceal the case bodies, and leave the storage space accessible;

and a door that can be attached to the flexible panel for covering and providing access to the storage space.

24. A system according to claim 23 further including a shelf that can be attached between the case bodies for supporting trade show materials in the accessible storage space.

* * * * *